US008031159B2

(12) United States Patent
Chen et al.

(10) Patent No.: US 8,031,159 B2
(45) Date of Patent: Oct. 4, 2011

(54) DRIVING CIRCUIT FOR TFT LIQUID CRYSTAL DISPLAY

(75) Inventors: Lin-Chien Chen, Hsin Chu (TW); Kun-Tsung Lin, Tai Chung (TW)

(73) Assignee: Sunplus Technology Co., Ltd., Hsin-Chu (TW)

( * ) Notice: Subject to any disclaimer, the term of this patent is extended or adjusted under 35 U.S.C. 154(b) by 918 days.

(21) Appl. No.: 11/644,944

(22) Filed: Dec. 26, 2006

(65) Prior Publication Data

US 2007/0152948 A1 Jul. 5, 2007

(30) Foreign Application Priority Data

Jan. 3, 2006 (TW) ..... 95100242 A

(51) Int. Cl.
*G09G 3/36* (2006.01)

(52) U.S. Cl. ..... 345/100
(58) Field of Classification Search ..... 345/87–104
See application file for complete search history.

(56) References Cited

U.S. PATENT DOCUMENTS

2002/0190971 A1* 12/2002 Nakamura et al. ..... 345/204
* cited by examiner

*Primary Examiner* — Amr Awad
*Assistant Examiner* — Kenneth Bukowski
(74) *Attorney, Agent, or Firm* — Muncy, Geissler, Olds & Lowe, PLLC

(57) ABSTRACT

A driving circuit for a liquid crystal display includes a plurality of driving units each including a first OP amplifier, a second OP amplifier and a plurality of switches for switching outputs and feedback paths of the OP amplifiers. Because the switches are disposed in the feedback paths of the OP amplifiers of the driving unit, an output impedance of the driving unit can be effectively reduced and the stable time of the output voltage can be shortened.

8 Claims, 7 Drawing Sheets

DRIVING CIRCUIT FOR TFT LIQUID CRYSTAL DISPLAY

This application claims the benefit of the filing date of Taiwan Application Ser. No. 095100242, filed on Jan. 3, 2006, the content of which is incorporated herein by reference.

BACKGROUND OF THE INVENTION

1. Field of Invention

The invention relates to a driving circuit for a liquid crystal display (LCD), and more particularly to a driving circuit having a plurality of switches disposed between a negative input terminal and an output terminal of an OP amplifier.

2. Related Art

A LCD typically needs a source driving circuit for driving a source of a thin film transistor (TFT) so as to control a transmission rate of the TFT. FIG. 1 shows a circuit of a driving unit 10 in a conventional driving circuit. Referring to FIG. 1, the driving unit 10 includes two OP amplifiers 11 and 12 and two switches 13 and 14. The positive input terminal of the first OP amplifier 11 receives a first analog signal outputted from a positive digital-to-analog converter (PDAC), and the output terminal of the first OP amplifier 11 is connected to an output node OUT through the first switch 13. The positive input terminal of the second OP amplifier 12 receives a second analog signal outputted from a negative digital-to-analog converter (NDAC), and the output terminal of the second OP amplifier 12 is also connected to the output node OUT through the second switch 14. In addition, the output terminal of each of the OP amplifiers 11 and 12 is directly fed back to the negative input terminal of the OP amplifier.

FIG. 2 shows another circuit of a driving unit 20 of the conventional driving circuit. As shown in FIG. 2, the driving unit 20 includes two OP amplifiers 11 and 12 and two switches 13 and 14, and further includes a third switch 13' and a fourth switch 14'. The connections between the OP amplifiers 11 and 12 and the two switches 13 and 14 of the driving unit 20 are the same as those of the driving unit 10 of FIG. 1. That is, the OP amplifiers 11 and 12 are connected to a first output node OUT_ODD through the switches 13 and 14. But the driving unit 20 further connects the output terminal of the first OP amplifier 11 to a second output node OUT_EVEN through the third switch 13', and connects the output terminal of the second OP amplifier 12 to the second output node OUT_EVEN through the fourth switch 14'.

However, the driving unit in either FIG. 1 or FIG. 2 has the equivalent circuit shown in FIG. 3 after the switch is turned on. So, the equivalent output impedance Rout viewed from the output node into the OP amplifier is:

$$Rout=Ron(OP)+Ron(\text{Switch}) \quad (1).$$

Because the output impedance Rout is increased due to the switch, the time of the stable output voltage of the output node is thus influenced so that the response speed of the LCD cannot be effectively enhanced.

SUMMARY OF THE INVENTION

It is therefore an object of the invention to provide a driving method and a driving circuit for a LCD with the greatly reduced output impedance.

The invention achieves the above-identified object by providing a driving circuit for a LCD. The driving circuit includes a plurality of driving units each including a first OP amplifier, a second OP amplifier and first to fourth switches.

The first OP amplifier has a positive input terminal for receiving a first analog signal, a negative input terminal and an output terminal. The second OP amplifier has a positive input terminal for receiving a second analog signal, a negative input terminal and an output terminal. The first switch is connected to the output terminal of the first OP amplifier and an output node. The second switch is connected to the negative input terminal of the first OP amplifier and the output node. The third switch is connected to the output terminal of the second OP amplifier and the output node. The fourth switch is connected to the negative input terminal of the second OP amplifier and the output node. When the driving unit wants to output the first analog signal, the first switch and the second switch are turned on while the third switch and the fourth switch are turned off. When the driving unit wants to output the second analog signal, the first switch and the second switch are turned off while the third switch and the fourth switch are turned on.

Because the output terminal of the OP amplifier of the invention is fed back to the negative input terminal through the switch, the output impedance can be greatly reduced, and the time of the stable output voltage of the output node can be shortened.

DETAILED DESCRIPTION OF THE INVENTION

Figure 1:
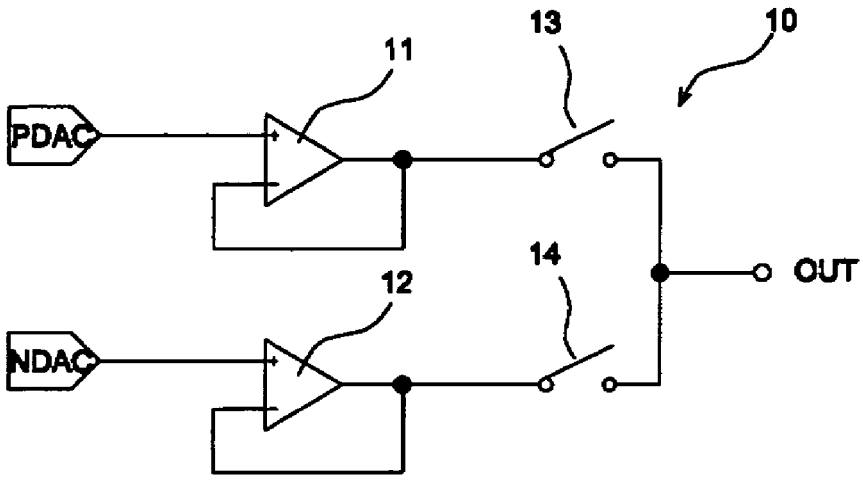
FIG. 1 (PRIOR ART)
FIG. 1 shows a circuit of a driving unit in a conventional driving circuit.
Figure 2:
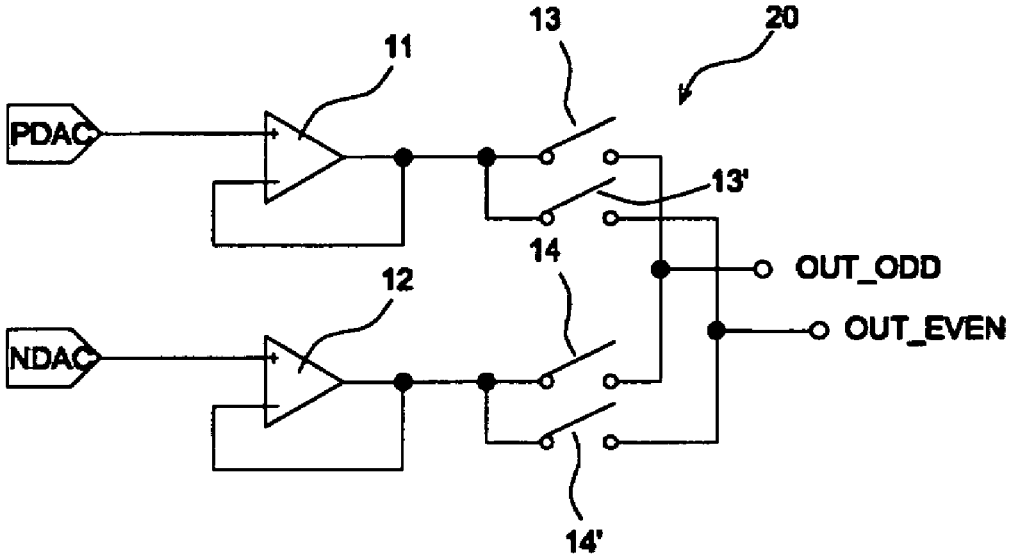
FIG. 2 (PRIOR ART)
FIG. 2 shows another circuit of the driving unit of the conventional driving circuit.
Figure 3:
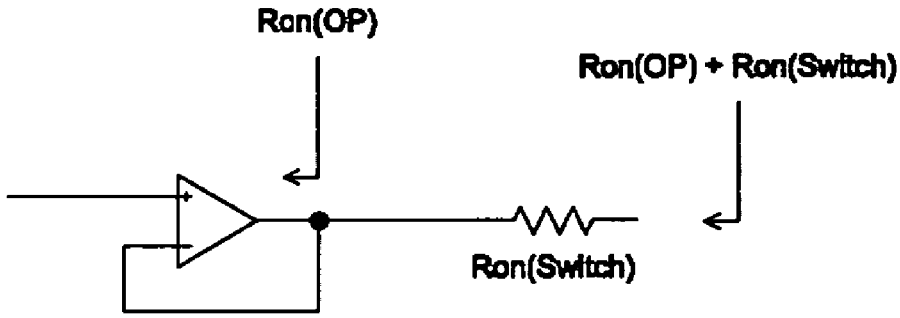
FIG. 3 (PRIOR ART)
FIG. 3 is a schematic illustration showing a connection between an OP amplifier and a switch in the conventional driving unit, and an output impedance thereof.
Figure 4:
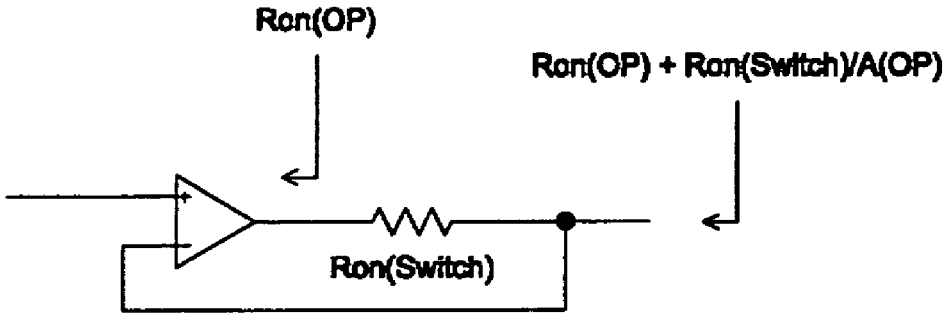
FIG. 4 is another schematic illustration showing the connection between the OP amplifier and the switch in the conventional driving unit, and the output impedance thereof.

The driving circuit for the liquid crystal display according to the invention will be described with reference to the accompanying drawings. In the prior art driving unit, the output terminal of the OP amplifier is directly fed back to the negative input terminal, so the output impedance is represented by Equation (1). However, if the output terminal of the OP amplifier is fed back to the negative input terminal through a switch, as shown in the circuit of FIG. 4, the output impedance Rout' is represented by:

$$Rout'=Ron(OP)+Ron(\text{Switch})/(1+A(op)*B) \quad (2).$$

So, the equivalent impedance of the switch is decreased from Ron(Switch) to Ron(Switch)/(1+A(op)*B), wherein A(op) represents an open loop gain of the OP amplifier, and B represents the gain of the feedback network. In a unit gain buffer, B is equal to 1. Usually, A(op) is about 40 dB to 80 dB. That is, the equivalent impedance Ron(Switch) of the switch is decreased several hundreds of times.

Figure 5A:
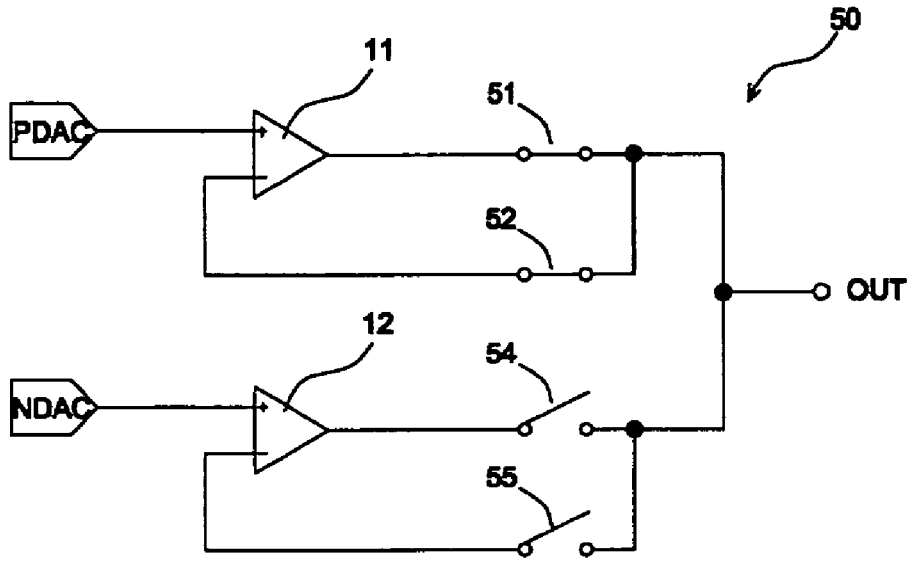
FIGS. 5A and 5B show circuits of a driving unit in a driving circuit according to a first embodiment of the invention.
Figure 5B:
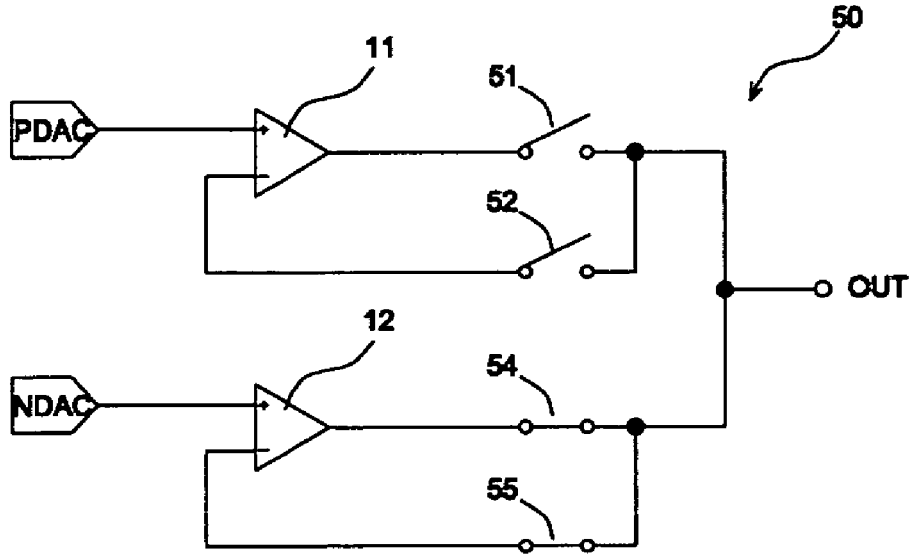

FIGS. 5A and 5B show circuits of a driving unit 50 in a driving circuit according to a first embodiment of the invention. The structures of FIGS. 5A and 5B are almost the same except for different turn-on states of switches. Referring to FIG. 5A, the driving unit 50 includes two OP amplifiers 11 and 12 and four switches 51, 52, 54 and 55. The positive input terminal of the first OP amplifier 11 receives a first analog signal, and the output terminal of the first OP amplifier 11 is connected to a first output node OUT through the first switch 51. The negative input terminal of the first OP amplifier 11 is connected to the first output node OUT through the second switch 52. The positive input terminal of the second OP amplifier 12 receives a second analog signal, and the output terminal of the second OP amplifier 12 is connected to the first output node OUT through the third switch 54. The negative input terminal of the second OP amplifier 12 is connected to the first output node OUT through the fourth switch 55.

In the driving unit 50 of FIG. 5A, the first switch 51 and the second switch 52 are turned on while the third switch 54 and the fourth switch 55 are turned off, so the first output node OUT outputs the first analog signal. In the driving unit 50 of FIG. 5B, the first switch 51 and the second switch 52 are turned off while the third switch 54 and the fourth switch 55 are turned on. So, the first output node OUT outputs the second analog signal.

Figure 6A:
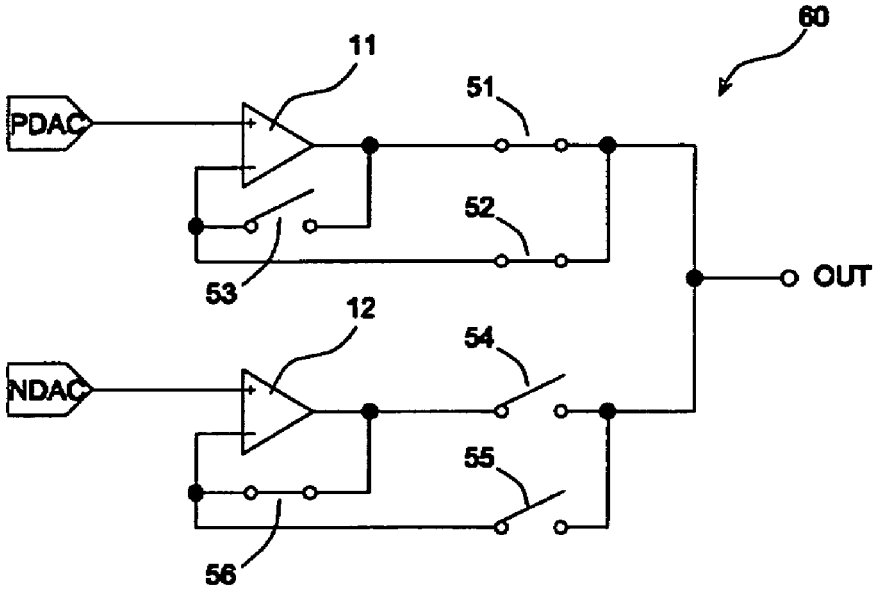
FIGS. 6A and 6B show circuits of a driving unit in a driving circuit according to a second embodiment of the invention.
Figure 6B:
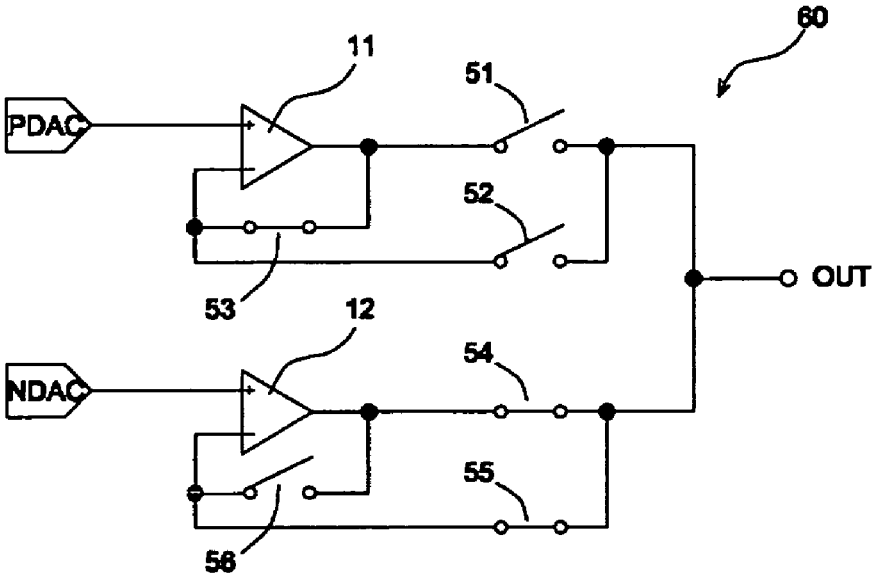

FIGS. 6A and 6B show circuits of a driving unit 60 in a driving circuit according to a second embodiment of the invention. The driving unit 60 of the embodiment is almost the same as the driving unit 50 of the first embodiment except that the driving unit 60 additionally has two switches 53 and 56, which are respectively connected to the output terminals and the negative input terminals of the OP amplifiers 11 and 12. The switch 53 or 56 is turned on to function to keep the voltage of the output terminal of the OP amplifier stable when the output terminal of the OP amplifier is cut off. That is, when the first switch 51 and the second switch 52 are turned off, the switch 53 is turned on so as to keep the voltage of the output terminal of the OP amplifier 11 stable.

Figure 7A:
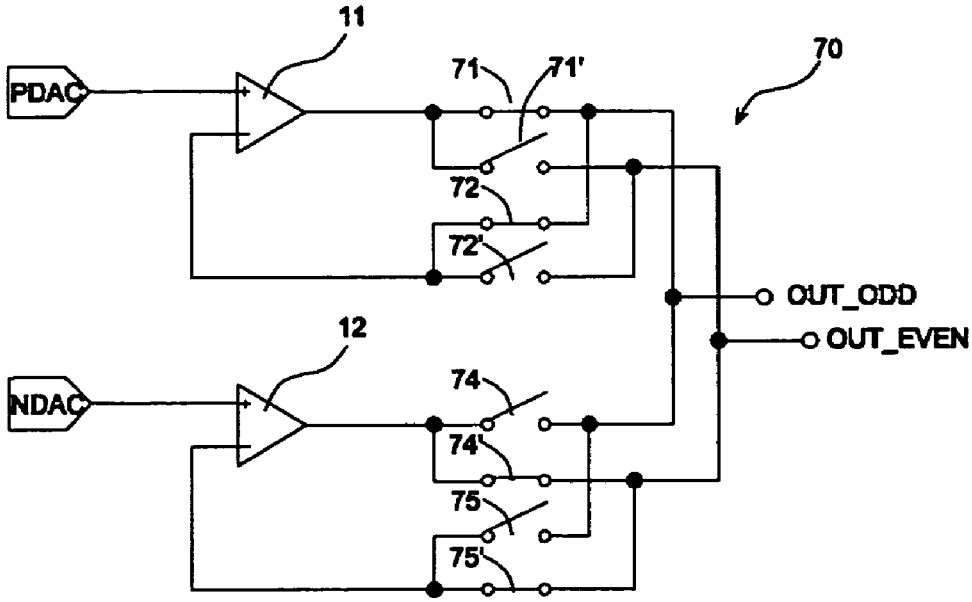
FIGS. 7A and 7B show circuits of a driving unit in a driving circuit according to a third embodiment of the invention.
Figure 7B:
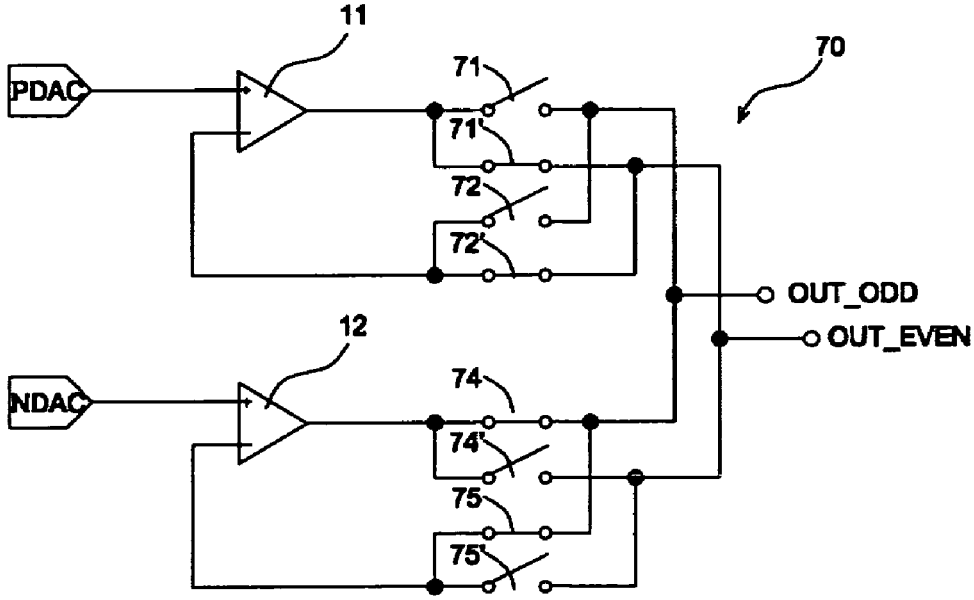

FIGS. 7A and 7B show circuits of a driving unit in a driving circuit according to a third embodiment of the invention. The structures of FIGS. 7A and 7B are almost the same except for the different turn-on states of the switches. Referring to FIG. 7A, a driving unit 70 includes two OP amplifiers 11 and 12 and eight switches 71, 72, 74, 75, 71', 72', 74' and 75'. The positive input terminal of the first OP amplifier 11 receives a first analog signal, and the output terminal of the first OP amplifier 11 is connected to a first output node OUT_ODD through the first switch 71, and is connected to a second output node OUT_EVEN through the switch 71'. The negative input terminal of the first OP amplifier 11 is connected to the first output node OUT_ODD through the switch 72 and is connected to the second output node OUT_EVEN through the switch 72'. The positive input terminal of the second OP amplifier 12 receives a second analog signal, and the output terminal of the second OP amplifier 12 is connected to the first output node OUT_ODD through the switch 74 and is connected to the second output node OUT_EVEN through the switch 74'. The negative input terminal of the second OP amplifier 12 is connected to the first output node OUT_ODD through the fourth switch 75 and is connected to the second output node OUT_EVEN through the fourth switch 75'.

The driving unit 70 is similar to the driving unit 50 of the first embodiment except that the driving unit 70 further has the four additional switches 71', 72', 74' and 75' to couple the output signal of the OP amplifier to the second output node OUT_EVEN. When the first output node OUT_ODD wants to output the signal of the first OP amplifier 11 and the second output node OUT_EVEN wants to output the signal of the second OP amplifier 12, as shown in FIG. 7A, the switches 71, 72, 74' and 75' are turned on while the switches 71', 72', 74 and 75 are turned off. When the first output node OUT_ODD wants to output the signal of the second OP amplifier 12 and the second output node OUT_EVEN wants to output the signal of the first OP amplifier 11, as shown in 7B, the switches 71, 72, 74' and 75' are turned off while the switches 71', 72', 74 and 75 are turned on.

Figure 8A:
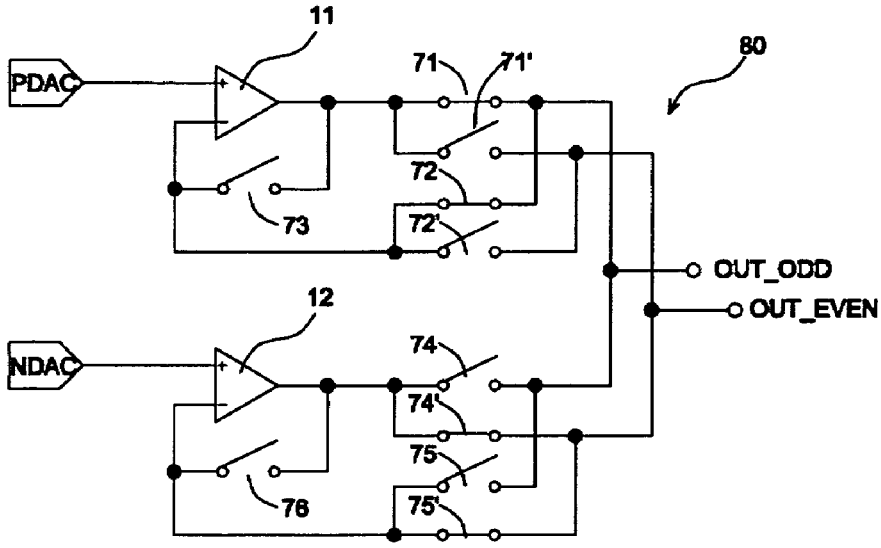
FIGS. 8A to 8C show circuits of a driving unit in a driving circuit according to a fourth embodiment of the invention.
Figure 8B:
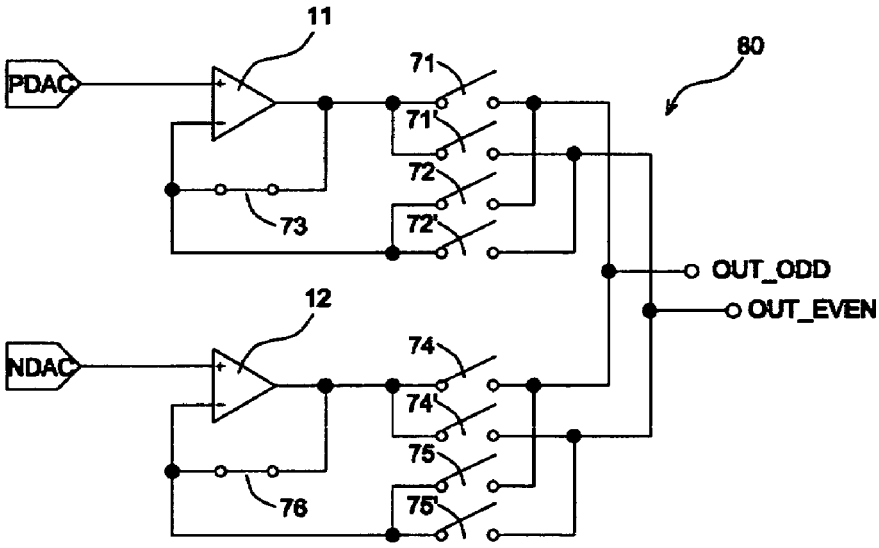
Figure 8C:
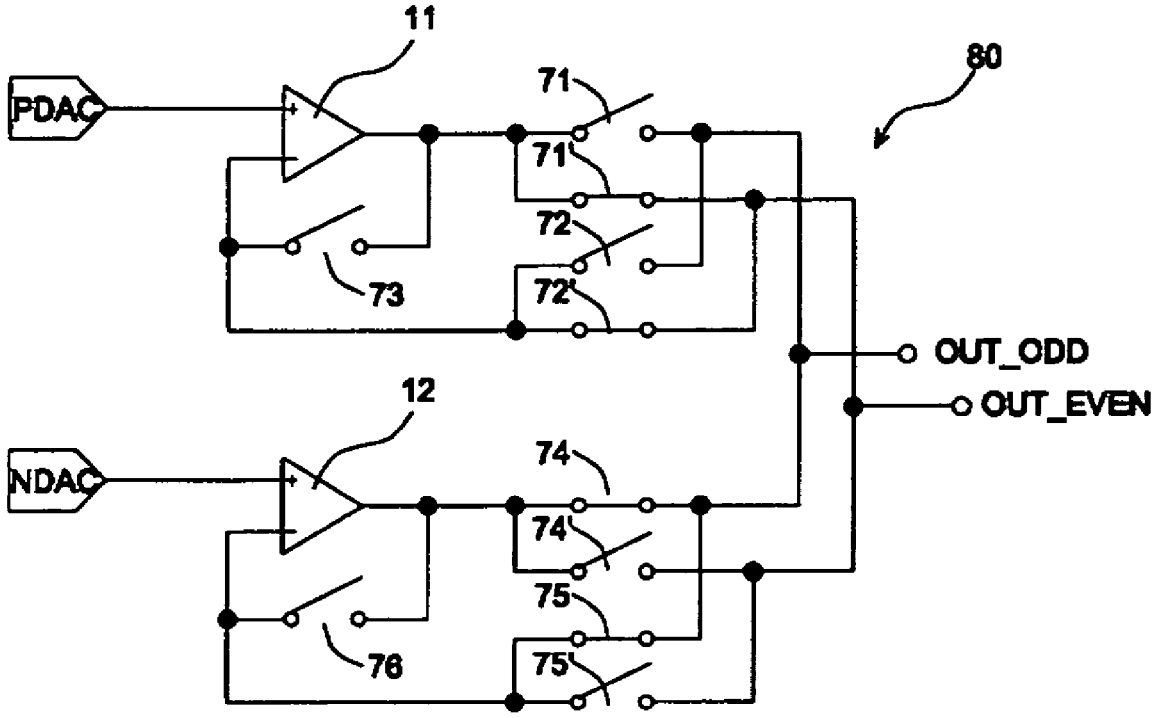

FIGS. 8A to 8C show circuits of a driving unit 80 in a driving circuit according to a fourth embodiment of the invention. The driving unit 80 of this embodiment is almost the same as the driving unit 70 of the third embodiment except that the driving unit 80 has two additional switches 73 and 76, which are respectively connected to the output terminals and the negative input terminals of the OP amplifiers 11 and 12. The switch 73 or 76 is turned on to function to keep the voltage of the output terminal of the OP amplifier stable when the output terminal of the OP amplifier is cut off. FIG. 8A shows the states of the switches when the first output node OUT_ODD outputs the signal of the first OP amplifier 11 and the second output node OUT_EVEN outputs the signal of the second OP amplifier 12. In this case, the switches 71, 72, 74' and 75' are turned on while the switches 71', 72', 74, 75, 73 and 76 are turned off. FIG. 8C shows the states of the switches when the first output node OUT_ODD outputs the signal of the second OP amplifier 12 and the second output node OUT_EVEN outputs the signal of the first OP amplifier 11. In this case, the switches 71, 72, 74' and 75' are turned off while the switch 71', 72', 74, 75, 73 and 76 are turned on.

When the driving unit 80 has to be switched from the state of FIG. 8A to the state of FIG. 8C, or from the state of FIG. 8C to the state of FIG. 8A, it has to be switched to the transient state of FIG. 8B, and then to the desired state. That is, the switches 73 and 76 are turned on and other switches are turned off in the transient state, as shown in FIG. 8B.

Thus, the switch is moved to the feedback path of the OP amplifier in the driving unit of the invention, so the output impedance of the driving unit can be greatly reduced, and the time of the stable output voltage of the driving unit can be shortened.

While certain exemplary embodiments have been described and shown in the accompanying drawings, it is to be understood that such embodiments are merely illustrative of and not restrictive on the broad invention, and that this invention not be limited to the specific construction and arrangement shown and described, since various other modifications may occur to those ordinarily skilled in the art.

What is claimed is:

1. A driving circuit for a liquid crystal display, the driving circuit comprising a plurality of driving units, each of the driving units comprising:

a first OP amplifier having a positive input terminal for receiving a first analog signal, a negative input terminal and an output terminal;

a second OP amplifier having a positive input terminal for receiving a second analog signal, a negative input terminal and an output terminal;

a first switch connected to the output terminal of the first OP amplifier and an output node;

a second switch connected to the negative input terminal of the first OP amplifier and the output node;

a third switch connected to the output terminal of the second OP amplifier and the output node; and a fourth switch connected to the negative input terminal of the second OP amplifier and the output node;

wherein when the driving unit wants to output the first analog signal, the first switch and the second switch are turned on while the third switch and the fourth switch are turned off; and when the driving unit wants to output the second analog signal, the first switch and the second switch are turned off while the third switch and the fourth switch are turned on, wherein an output impedance from the first switch to the first OP amplifier is defined as $$Rout1=Ron1+Ronsw1/(1+Aop1*B),$$

and an output impedance from the third switch to the second OP amplifier is defined as $$Rout2=Ron2+Ronsw3/(1+Aop2*B),$$

wherein Rout1 represents the output impedance from the first switch to the first OP amplifier, Rout2 represents the output impedance from the third switch to the second OP amplifier, Ron1 represents the output impedance of the first OP amplifier, Ron2 represents the output impedance of the second OP amplifier, Ronsw1 represents the impedance of the first switch, Ronsw3 represent the impedance of the third switch, Aop1 represent an open-loop gain of the first OP amplifier, Aop2 represent an open-loop gain of the second OP amplifier, B represents a transfer gain of a feedback loop, wherein the second switch is directly connected to the negative input terminal of the first OP amplifier and the output node.

2. The driving circuit according to claim 1, wherein the driving unit further comprises:

a fifth switch connected to the output terminal of the first OP amplifier and the negative input terminal of the first OP amplifier; and a sixth switch connected to the output terminal of the second OP amplifier and the negative input terminal of the second OP amplifier;

wherein when the driving unit wants to output the first analog signal, the fifth switch is turned off while the sixth switch is turned on; and when the driving unit wants to output the second analog signal, the fifth switch is turned on while the sixth switch is turned off.

3. A driving circuit for a liquid crystal display, the driving circuit comprising a plurality of driving units, each of the driving unit comprising:

a first OP amplifier having a positive input terminal for receiving a first analog signal, a negative input terminal and an output terminal;

a second OP amplifier having a positive input terminal for receiving a second analog signal, a negative input terminal and an output terminal;

a first switch connected to the output terminal of the first OP amplifier and a first output node;

a second switch connected to the output terminal of the first OP amplifier and a second output node;

a third switch connected to the negative input terminal of the first OP amplifier and the first output node;

a fourth switch connected to the negative input terminal of the first OP amplifier and the second output node;

a fifth switch connected to the output terminal of the second OP amplifier and the first output node;

a sixth switch connected to the output terminal of the second OP amplifier and the second output node;

a seventh switch connected to the negative input terminal of the second OP amplifier and the first output node;

an eighth switch connected to the negative input terminal of the second OP amplifier and the second output node;

wherein when the driving unit wants to output the first analog signal from the first output node and to output the second analog signal from the second output node, the first switch, the third switch, the sixth switch and the eighth switch are turned on while the second switch, the fourth switch, the fifth switch and the seventh switch are turned off; and when the driving unit wants to output the second analog signal from the first output node and to output the first analog signal from the second output node, the first switch, the third switch, the sixth switch and the eighth switch are turned off while the second switch, the fourth switch, the fifth switch and the seventh switch are turned on, wherein an output impedance from the first switch to the first OP amplifier is defined as $$Rout1=Ron1+Ronsw1/(1+Aop1*B),$$

an output impedance from the second switch to the first OP amplifier is defined as $$Rout2=Ron1+Ronsw2/(1+Aop1*B),$$

an output impedance from the fifth switch to the second OP amplifier is defined as $$Rout3=Ron2+Ronsw5/(1+Aop2*B),$$

and an output impedance from the sixth switch to the second OP amplifier is defined as $$Rout4=Ron2+Ronsw6/(1+Aop2*B),$$

wherein Rout1 represents the output impedance from the first switch to the first OP amplifier, Rout2 represents the output impedance from the second switch to the first OP amplifier, Rout3 represents the output impedance from the fifth switch to the second OP amplifier, Rout4 represents the output impedance from the sixth switch to the second OP amplifier, Ron1 represents the output impedance of the first OP amplifier, Ron2 represents the output impedance of the second OP amplifier, Ronsw1 represents the impedance of the first switch, Ronsw2 represents the impedance of the second switch, Ronsw5 represents the impedance of the fifth switch, Ronsw6 represents the impedance of the sixth switch, Aop1 represent an open-loop gain of the first OP amplifier, Aop2 represent an open-loop gain of the second OP amplifier, B represents a transfer gain of a feedback loop, wherein the third switch is directly connected to the negative input terminal of the first OP amplifier and the first output node.

4. The driving circuit according to claim 3, wherein the driving unit further comprises:

a ninth switch connected to the output terminal of the first OP amplifier and the negative input terminal of the first OP amplifier; and a tenth switch connected to the output terminal of the second OP amplifier and the negative input terminal of the second OP amplifier;

wherein when the driving unit wants to convert the first analog signal outputted from the first output node into the second analog signal and to convert the second analog signal outputted from the second output node into the first analog signal, the ninth switch and the tenth switch are turned on while the first to eighth switches are turned off for a default period of time, and then the ninth switch and tenth switch are turned off, and the second switch, the fourth switch, the fifth switch and the seventh switch are turned on; and when the driving unit wants to convert the second analog signal outputted from the first output node into the first analog signal and to convert the first analog signal outputted from the second output node into the second analog signal, the ninth switch and the tenth switch are turned on while the first to eighth switches are turned off for the default period of time, and then the ninth switch and the tenth are switch turned off, and the first switch, the third switch, the sixth switch and the eighth switch are turned on.

5. The driving circuit according to claim 1, wherein the fourth switch is directly connected to the negative input terminal of the first OP amplifier and the output node.

6. The driving circuit according to claim 3, wherein the fourth switch is directly connected to the negative input terminal of the first OP amplifier and the second output node.

7. The driving circuit according to claim 3, wherein the seventh switch is directly connected to the negative input terminal of the second OP amplifier and the first output node.

8. The driving circuit according to claim 3, wherein the eighth switch is directly connected to the negative input terminal of the second OP amplifier and the second output node.

* * * * *